US005711660A

United States Patent [19]

Mitarai et al.

[11] Patent Number: 5,711,660

[45] Date of Patent: Jan. 27, 1998

[54] INTERNAL GEAR TYPE ROTARY PUMP HAVING A RELIEF GROOVE

[75] Inventors: Mutsumi Mitarai; Atsushi Kobayashi, both of Fuji, Japan

[73] Assignee: Jatco Corporation, Fuji, Japan

[21] Appl. No.: 670,818

[22] Filed: Jun. 25, 1996

[30] Foreign Application Priority Data

Jun. 30, 1995 [JP] Japan ..... 7-165245

[51] Int. Cl.[6] ..... F04C 2/10

[52] U.S. Cl. ..... 418/79; 418/102; 418/171

[58] Field of Search ..... 418/75, 79, 102, 418/166, 171, 189

[56] References Cited

U.S. PATENT DOCUMENTS

| | | | |
|---|---|---|---|
| 1,799,237 | 4/1931 | Jensen | 418/79 |
| 2,948,229 | 8/1960 | Brundage | 418/171 |
| 3,995,978 | 12/1976 | Khan et al. | 418/171 |
| 4,199,305 | 4/1980 | Pareja | 418/102 |
| 5,263,818 | 11/1993 | Ito et al. | 418/171 |

FOREIGN PATENT DOCUMENTS

| | | |
|---|---|---|
| 0 664 395 | 7/1995 | European Pat. Off. . |
| 76 162 | 9/1970 | German Dem. Rep. . |
| 61-81588 | 4/1986 | Japan . |
| 61-83491 | 4/1986 | Japan . |
| 61-83494 | 4/1986 | Japan . |
| 61-138893 | 6/1986 | Japan . |

*Primary Examiner*—John J. Vrablik
*Attorney, Agent, or Firm*—Foley & Lardner

[57] ABSTRACT

Along a peripheral wall surface of a pump housing at a closure portion where a working fluid in a volume chamber defined by engagement of an inner rotor and an outer rotor, is enclosed, a liquid pressure is relieved by the liquid pressure relieving groove for relieving a liquid pressure of the working fluid from the volume chamber to a sliding gap along an outer peripheral surface of the outer rotor.

6 Claims, 5 Drawing Sheets

INTERNAL GEAR TYPE ROTARY PUMP HAVING A RELIEF GROOVE

BACKGROUND OF THE INVENTION

1. Field of the Invention

The present invention relates generally to an internal gear type rotary pump. More specifically, the invention relates to an internal gear type rotary pump of the form introducing a working fluid into a volume chamber defined between inner rotors having mutually meshing gear teeth from an inlet port, and pressurizing and discharging the working fluid from a discharge port depending upon variation of volume of the volume chamber according to rotation.

2. Description of the Related Art

Conventionally, internal gear type rotary pumps of this type are frequently used, suitable as a pump for circulating a lubricant of an internal combustion engine. Such internal gear type rotary pump is characterized by smaller number of parts, compact and light weight, requiring less space for installation, low cost and so forth. Also, the internal gear type rotary pump is easy to mass produce. On gears of an inner rotor and an outer rotor constituting such internal gear type rotary pump, various trochoidal curve teeth and so forth are employed for realizing smooth engagement. Various contours of the gear teeth are known as disclosed in Japanese Patent Application Laid-open No. 138893/1986 and Japanese Patent Application Laid-open No. 81588/1986, for "Trochoidal Type Oil Pump" or Japanese Patent Application Laid-open No. 83491/1986 for "Internal Contact Type Gear Pump", for example.

Amongst, one disclosed in Japanese Patent Application Laid-open No. 138893/1986, a housing groove, which slidingly contacts with a side wall surface of gear teeth the inner rotor, is provided at a position inclined to a discharge port across a closure portion where a volume of the volume chamber becomes maximum. Also, in order to establish communication between the volume chamber and the housing groove, a rotor groove is formed on the side surface of the gear teeth of the inner rotor for preventing an oil from back-flowing from the discharge port to the volume chamber in the vicinity of the closure portion, and for avoiding noise and wearing of the gear teeth caused by fluctuation of rotation of the rotor. On the other hand, as disclosed in Japanese Patent Application Laid-open No. 83491/1986, a circumferentially extending groove is formed on the side surface of an outer rotor for establishing communication between adjacent volume chambers. Alternatively, as disclosed in Japanese Patent Application Laid-open No. 81588/1986, a circumferentially extending groove is formed on the side surface of the inner rotor for establishing communication between adjacent volume chambers, and for communicating the volume chamber to the discharge port in the vicinity of the closure portion via the groove so that abrupt pressure variation in the vicinity of the closure portion and occurrence of a peak pressure can be avoided.

Namely, as can be clear from the discussed set forth above, in the internal gear type rotary pump, centrifugal force acts on the working fluid associating with rotation of the inner rotor and the outer rotor. Therefore, in the vicinity of the closure portion, a liquid pressure, due to abrupt elevation of the pressure at bottom of the gear teeth of the outer rotor in the volume chamber, is exerted to cause peak of the pressure to cause significant pressure variation upon shifting of the volume chamber to the discharge port. Furthermore, pressure variation becomes greater at higher rotation speed of the pump. As measures for such problem, various proposals have been made as set forth above.

However, when the fluid passage groove for relieving the fluid pressure from the volume chamber is formed on the side surface of the gear teeth of the inner rotor or the outer rotor or on the opposing side surface of the housing as in the prior art, since elevation of the fluid pressure is the most abrupt at the bottom of the gear teeth of the outer rotor, construction becomes complicated to make machining cumbersome while elimination of the abrupt pressure variation is insufficient.

On the other hand, a large number of fluid passage grooves have to be formed to easily cause wearing on the surface slidingly contacting with the portion where the fluid passage grooves are formed.

Furthermore, as the direction to form the fluid passage groove is centripetal relative to the circumferential direction or rotating direction, flow of the working fluid in the direction of centrifugal force is obstructed to degrade pressure relieving effect. Furthermore, since the discharge side and the inlet side are constantly communicated via a plurality of fluid passage grooves, the discharge amount is inherently lowered.

SUMMARY OF THE INVENTION

The present invention has been contemplated in view of the problems in the prior art set forth above. Therefore, it is an object of the present invention to provide an internal gear type rotary pump that can successfully avoid abrupt pressure variation otherwise caused in the vicinity of a closure portion or so forth, with simple construction.

In order to accomplish the above-mentioned object, an internal gear type rotary pump, according to the present invention, is characterized in that, among a closure portion and an engaging portion where a working fluid in a volume chamber defined by meshing of external gear teeth of an inner rotor and internal gear teeth of an outer rotor is enclosed therein, at least on a wall surface of a pump housing located corresponding to the closure portion, a thin groove establishing communication between the volume chamber and a sliding gap defined between an outer peripheral surface of the outer rotor and a sliding contact surface of the pump housing, is provided for relieving a liquid pressure of the working fluid.

With the present invention, the working fluid is enclosed condition at the closure portion and the engaging portion, and a centrifugal force generated by rotation of the rotors acts on the bottom of the gear teeth of the outer rotor. Then, by the thin groove formed along the wall surface of the pump housing, a part of the working fluid is introduced into a gap between the outer periphery surface of the outer rotor and the surface slidingly contact thereto from the volume chamber for relieving the liquid pressure. Thus, variation of the discharge pressure to be induced particularly at high rotation speed can be lowered.

With the construction wherein, among a closure portion and an engaging portion where a working fluid in a volume chamber defined by meshing of external gear teeth of an inner rotor and internal gear teeth of an outer rotor is enclosed therein, at least on a wall surface of a pump housing located corresponding to the closure portion, a thin groove establishing communication between the volume chamber and a sliding gap defined between an outer peripheral surface of the outer rotor and a sliding contact surface of the pump housing, is provided for relieving a liquid pressure of the working fluid, pressure fluctuation due to abrupt elevation of the liquid pressure in the volume chamber particularly in the vicinity of the closure portion can be effectively restricted with simple construction.

In addition to the effect set forth above, since the working fluid is supplied to both gaps defined on the side surface and the peripheral wall surface of the housing, on which the outer rotor slidingly contact via the radial groove and the distributed groove, lubricating performance can be enhanced. Thus, precision of the gap between the peripheral surface in the pumping chamber of the housing and the outer peripheral surface of the outer rotor can be improved to enhance pumping efficiency.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to more clearly describe the present invention.

Figure 1:
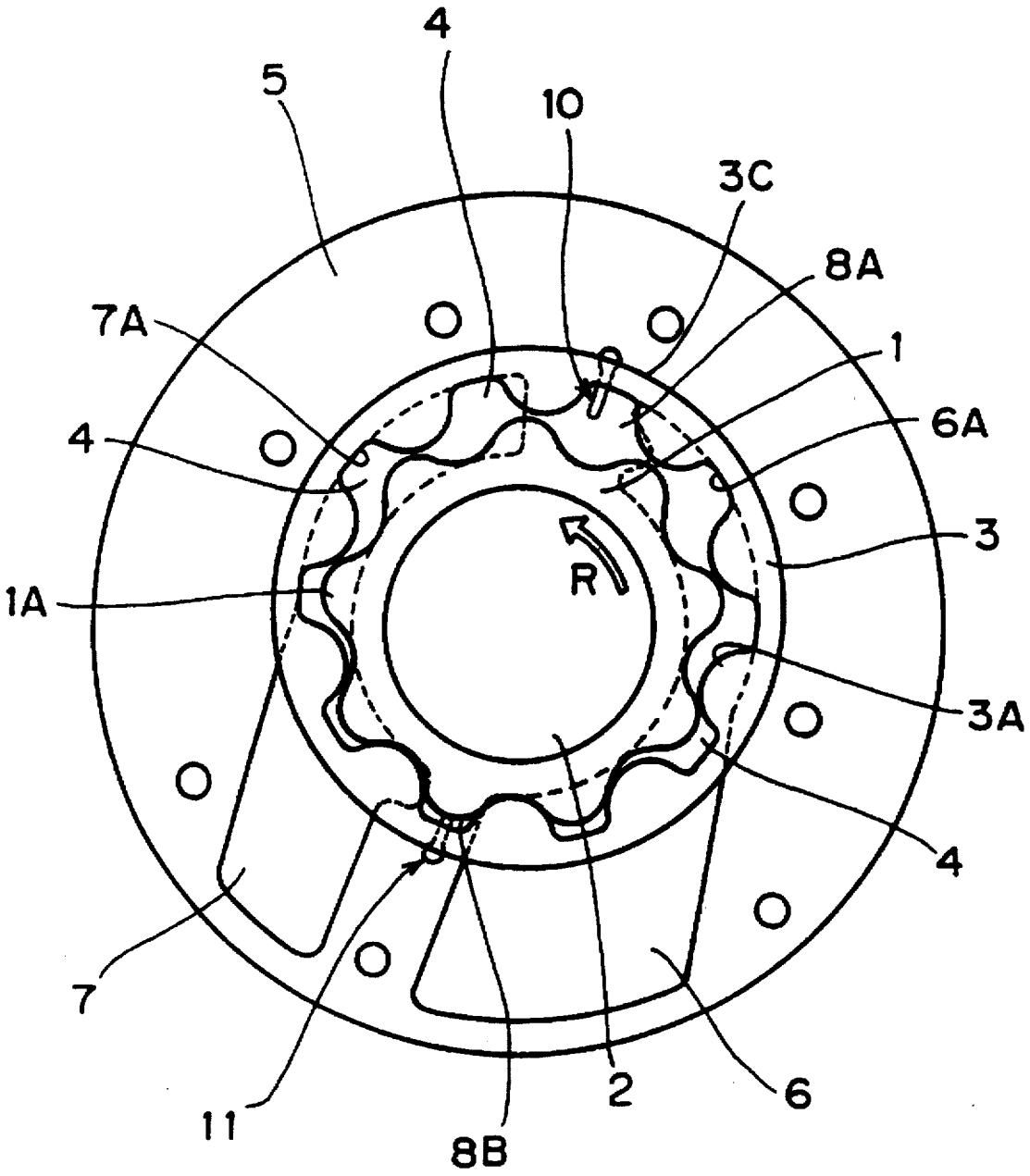
FIG. 1 is a front elevation showing the first embodiment of an internal gear type rotary pump, illustrated in a condition where a cover is removed.
Figure 2A:
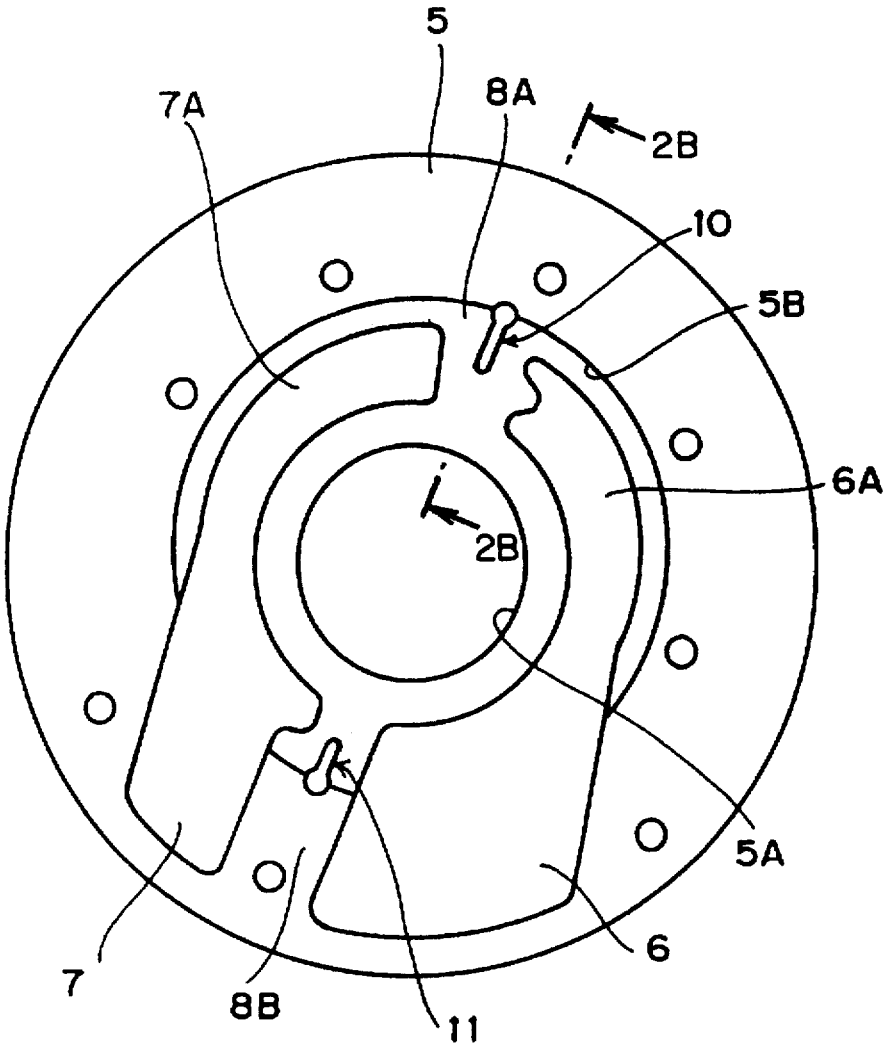
FIG. 2A is a front elevation of a pump housing in the first embodiment of the internal gear type rotary pump of the invention.
Figure 2B:
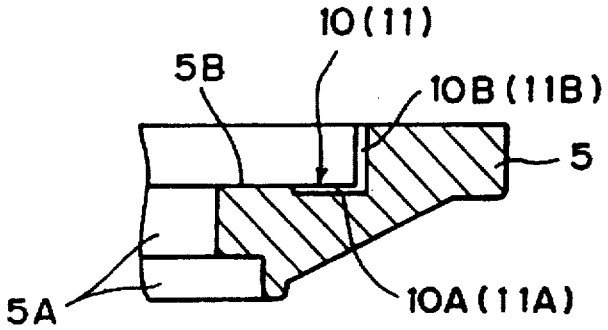
FIG. 2B is a section taken along line 2B—2B in FIG. 2A.
Figure 3:
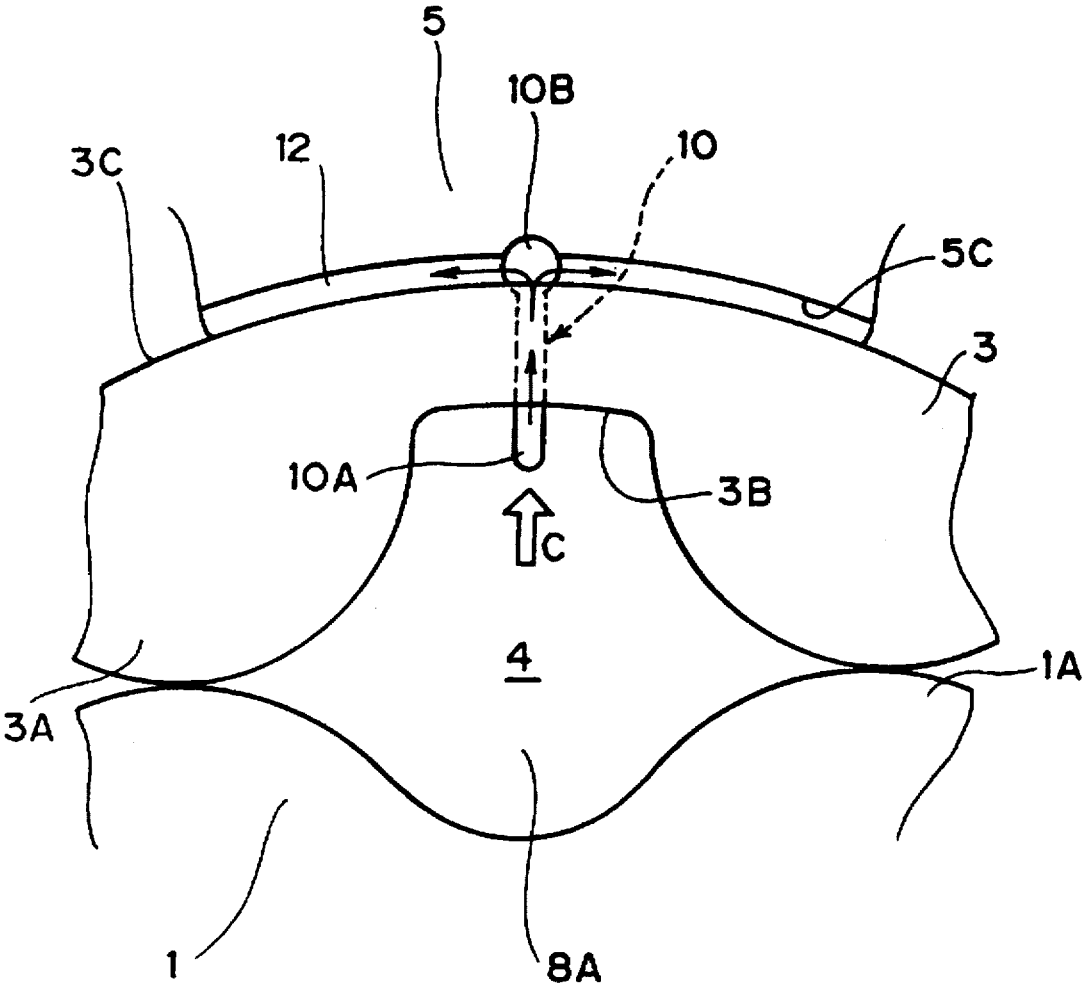
FIG. 3 is an enlarged explanatory illustration showing a construction in the vicinity of a closure portion in the first embodiment of the internal gear type rotary pump.

FIGS. 1 to 3 show the first embodiment of an internal gear type rotary pump according to the present invention. The shown embodiment of the internal gear type rotary pump is arranged between a torque converter and a power transmission in an automatic power transmission, for example. In FIG. 1, the reference numeral 1 denotes an inner rotor having a plurality of external gear teeth 1A and is driven to rotate by a drive shaft 2. The reference numeral 3 denotes an outer rotor having internal gear teeth 3A, number of which internal gear teeth is one greater than the number of the external gear teeth 1A of the inner rotor 1. The outer rotor 3 is driven to rotate by meshing the internal gear teeth 3A with the external gear teeth 1A of the inner rotor 1. The external gear teeth 1A and the internal gear teeth 3A are formed into trochoidal gear shape for example. It should be noted that the external gear teeth 1A of the inner rotor 1 and the internal gear teeth 3A of the outer rotor 3 engage as shown to mutually contact the gear teeth for defining pumping chambers (volume chambers) 4 between the gear teeth. The reference numeral 5 denotes a pump housing rotatably receiving the inner rotor 1 and the outer rotor 3. 6 and 7 respectively denote an inlet port and a discharge port provided in the pump housing 5.

As shown in FIG. 2A, the inlet port 6 and the discharge port 7 have an extended inlet portion 6A and an extended discharge portion 7A extending over a plurality of volume chambers in circumferential direction, respectively. On the other hand, 8A denotes a top dead center (closure portion) and 8B denotes a bottom dead center (engaging portion). A rotor sliding wall of the pump housing 5 is formed so that the volume chambers 4 are closed at the closure portion 8A and the engaging portion 8B. The rotors 1 and 3 are combined to engage the gear teeth so that the volume of the volume chamber 4 becomes maximum in the vicinity of the closure portion 8A, and is contracted to be minimum in the vicinity of the engaging portion 8B. As can be seen, the closure portion 8A and the engaging portion 8B are located at symmetric position relative to the center axis of the drive shaft 2. Here, an arrow R shows the rotating direction of the inner rotor 1 and the outer rotor 3. It should be noted that, as shown in FIG. 2A, a bearing bore 5A for receiving the drive shaft 2 in liquid tight fashion, and a recessed portion (pump chamber) 5B for rotatably receiving the outer rotor 3 together with the inner rotor 1 are provided in the pump housing 5. By contacting and fixing a not shown cover member to the pump housing 5, liquid tight seal of the pump chamber 5B can be established.

10 and 11 denote fluid pressure relieving grooves according to the present invention. As shown in FIG. 2A, the pressure relieving grooves 10 and 11 are respectively provided in the closure portion 8A and the engaging portion 8B of the pump housing 5. It should be noted that 10A and 11A are grooves (hereinafter referred to as "radial groove") in the fluid pressure relieving grooves 10, 11 extending in the radial direction, 10B and 11B denote grooves (hereinafter referred to as "distributed groove") continuous to the radial grooves 10A and 11A and extending in the circumferential direction along circumferantial surface of the pump chamber 5B. The radial grooves 10A and 11A and the distributed grooves 10B and 11B have predetermined depth and groove width. For example, in the shown embodiment, the depth is approximately 0.8 mm and the groove width is approximately 1 to 2 mm.

Next, a working fluid feeding operation of the internal gear type rotary pump constructed as set forth above will be discussed.

Such rotary pump is generally used as an oil pump associated with a crankshaft of an internal combustion engine. As shown in FIG. 1, by rotation of the drive shaft 2 in the direction of the arrow R, the inner rotor 1 and the outer rotor 3 meshing with the inner rotor 1 are driven to rotate in the same direction. Associating with rotation, the volume chamber 4 which is maintained at the minimum volume at the engaging portion 8B is gradually increased. According to increasing of the volume of the volume chamber 4, the working fluid (lubricant oil in case of the oil pump) is introduced into the volume chamber 4 through the inlet port 6 and the extended inlet portion 6A. The volume of the volume chamber 4 becomes substantially maximum at the closure portion 8A. Thereafter, the volume chamber 4 is communicated with the extended discharge portion 7A, and gradually decreased according to rotation to discharge the working fluid into the discharge port 7 via the extended discharge portion 7A. Then, the pressurized working fluid is fed into the circulating system from the discharge port 7.

In such pumping operation, a large centrifugal force acts on the oil (working fluid) in the volume chambers 4 by rotating motion of the rotors 1 and 3. Then, liquid pressure in the bottom of the gear teeth of the outer rotor 3 (see FIG. 3) is particularly elevated and becomes maximum in the vicinity of a position immediately after passing across the closure portion 8A. Subsequently, the liquid pressure is abruptly lowered by establishing communication between the volume chamber 4 and the extended discharge portion 7A. Variation of the discharge pressure is most significant in the vicinity of this position. On the other hand, associating with subsequent contraction of the volume chamber 4, the working fluid is pushed toward the discharge side to elevate the liquid pressure. However, in the shown embodiment, as shown in FIG. 3, by the liquid pressure relieving groove 10 provided on the wall surface of the housing 5 at the closure portion 8A, the liquid pressure in the volume chamber 4 is introduced into a sliding gap 12 between the outer peripheral surface 3C of the outer rotor 3 and the peripheral wall surface 5C of the pumping chamber 5B of the pump housing 5 to relieve the liquid pressure to the inlet port 6 via the gap 12. The sliding gap 12 is formed over the entire circumference along the outer peripheral surface 3C of the outer rotor 3.

On the other hand, similarly, by the liquid pressure relieving groove 11, the liquid pressure in the volume chamber 4 at the engaging portion 8B is introduced into a gap 12 for rotation to relieve to the inlet port 6. The reason why the liquid pressure is relieved toward the inlet port 6 is that the liquid pressure acts from the discharge port 7. While no discussion is given with respect to the cover (not shown) side in .the shown embodiment, similar configuration of radial grooves (not shown) may be provided at positions opposing to the radial grooves 10A and 11A at the cover side at the closure portion 8A and the engaging portion 8B. It is possible to communicate these radial grooves to the distributed grooves 10B and 11B set forth above.

Figure 4A:
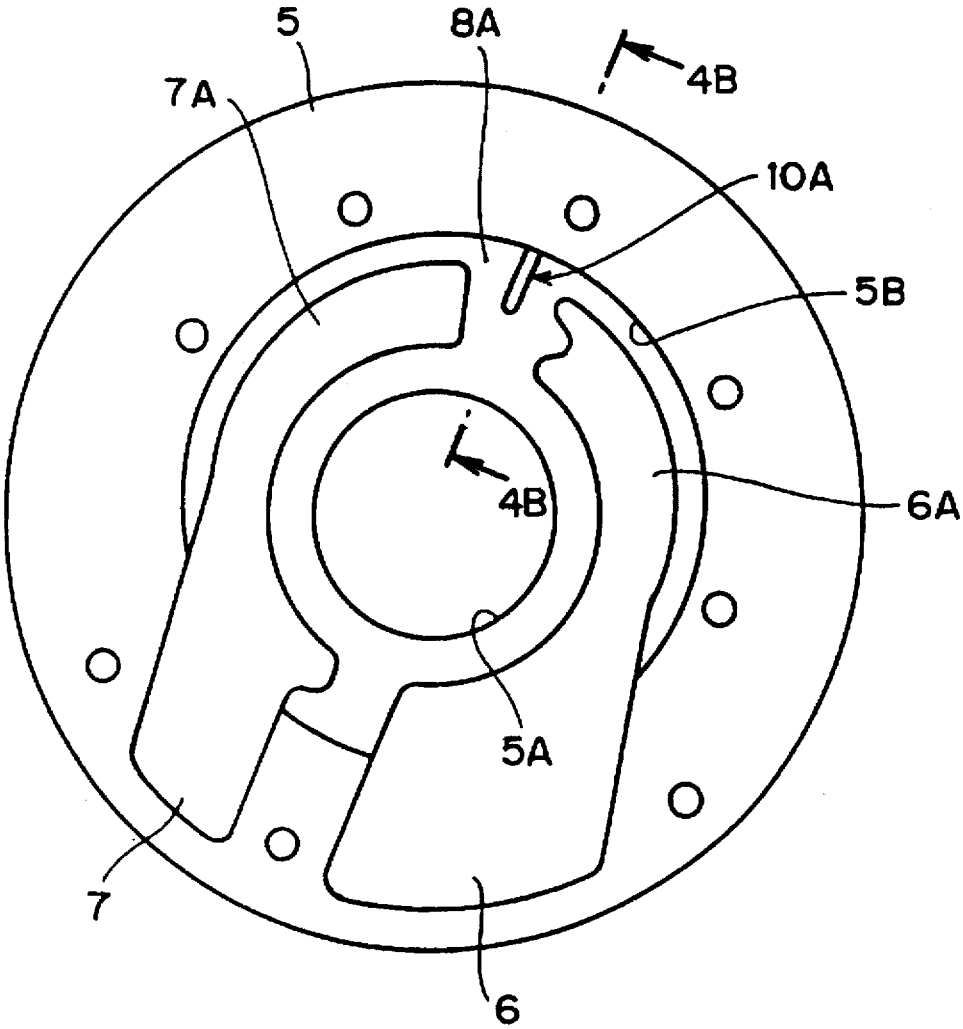
FIG. 4A is a front elevation of a pump housing in the second embodiment of the internal gear type rotary pump of the invention.
Figure 4B:
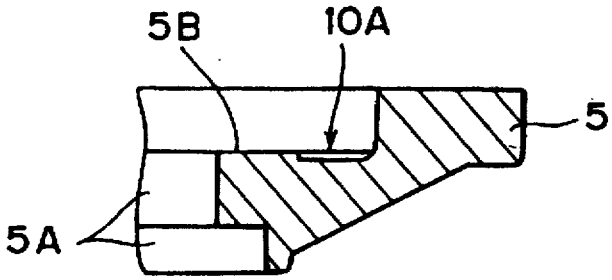
FIG. 4B is a section taken along line 4B—4B in FIG. 4A.

FIG. 4 shows the second embodiment of the present invention. The shown embodiment is provided with only radial grooves 10A as the liquid pressure relieving groove on the wall surface of the pump housing 5 at the closure portion 8A. In the volume chamber 4, the liquid pressure becomes the highest in the bottom of the gear teeth of the outer rotor 3 in the vicinity of the closure portion 8A. Thus, the liquid pressure is effectively relieved by restricting to the wall surface of this portion. At this time, since the sliding gap 12 is greater than the gap between the end surface of the outer rotor 3 and the wall surface of the pump housing 5, no problem will arise even when the distributed groove is not provided on the peripheral surface 5C. It is also possible to similarly provide only radial groove 11A in the engaging portion 8B. Also, while not clearly shown in the drawings, similar radial grooves may be provided at the cover side in addition to the shown embodiment.

With the shown embodiment, a cost for processing can be further lowered in comparison with the foregoing first embodiment with achieving substantially equivalent effect to the first embodiment.

Figure 5:
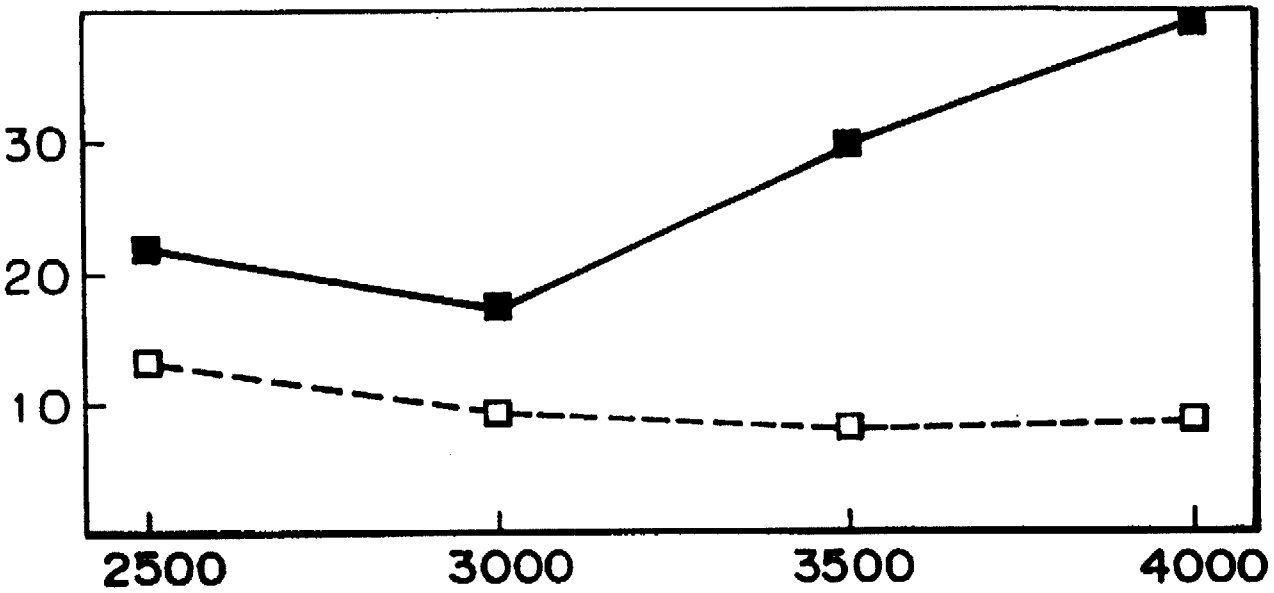
FIG. 5 is a chart of characteristic curve showing a relationship between a pump rotation speed and oscillation level of a discharge pressure.

FIG. 5 shows a relationship between a pump rotation speed (r.p.m.) and vibration level (dB) due to fluctuation of the discharge pressure. According to the present invention, variation of the liquid pressure can be successfully restricted to effectively lower the vibration level (dB) in a high pump rotation speed range higher than or equal to 500 r.p.m. in comparison with the prior art, in which no measure has been taken. It should be noted that, in FIG. 5, black squares represent measured values in the prior art and white squares represent measured values in the first embodiment of the present invention.

It should be noted that while the liquid pressure relieving grooves 10 and 11 are respectively provided with the radial grooves and the distributed grooves, such construction is not essential to the present invention. For example, it is also possible to provide only radial groove for one of the liquid pressure relieving grooves 10 and 11 similarly to that in the second embodiment.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments that can be embodied within a scope encompassed and equivalents thereof with respect to the feature set out in the appended claims.

What is claimed is:

1. An internal gear type rotary pump comprising:

a pump housing having a pump chamber defined by a peripheral surface and side surfaces, at least one of which is provided with an inlet port and a discharge port;

an outer rotor having internal gear teeth, the outer rotor being rotatably disposed in the pump chamber; and an inner rotor having external gear teeth, the external gear teeth being meshed with the internal gear teeth to define a variable volume chamber between the external gear teeth and the internal gear teeth for varying a volume of the volume chamber between a maximum volume at a closure portion and a minimum volume at an engaging portion, wherein a sliding gap is defined between an outer peripheral surface of the outer rotor and the peripheral surface of the pump chamber, the sliding gap communicating with the inlet port and the discharge port, and wherein at least one of the side surfaces at the closure portion has a thin groove having a closed end, the thin groove establishing communication between the variable volume chamber and the sliding gap so that working fluid in the closure portion escapes through the thin groove.

2. An internal gear type rotary pump according to claim 1, wherein the thin groove extends from the one side surface of the pump chamber to the peripheral surface of the pump chamber.

3. An internal gear type rotary pump according to claim 1, wherein the thin groove extends only on the side surfaces of the pump chamber.

4. An internal gear type rotary pump according to claim 1, wherein the thin groove provided on the side surfaces of the pump chamber extends along a radial direction of the outer rotor.

5. An internal gear type rotary pump according to claim 1, further including another thin groove provided on the one side surface of the pump chamber at the engaging portion.

6. An internal gear type rotary pump according to claim 1, wherein the thin groove comprises a radial groove formed on the one side surface of the pump chamber extending in a radial direction of the outer rotor, and an axial groove continuous with the radial groove and formed on the peripheral surface of the pump chamber in an axial direction of the outer rotor.

* * * * *